United States Patent [19]

Sachetti

[11] Patent Number: 4,894,101

[45] Date of Patent: Jan. 16, 1990

[54] METHOD OF MAKING PROTECTION COVER

[76] Inventor: Terrance W. Sachetti, 5930 W. Broadway, Crystal, Minn. 55428

[21] Appl. No.: 223,424

[22] Filed: Jul. 25, 1988

Related U.S. Application Data

[62] Division of Ser. No. 934,462, Nov. 24, 1986, Pat. No. 4,759,090.

[51] Int. Cl.[4] ..... B44C 1/28

[52] U.S. Cl. ..... 156/67; 5/502; 8/102; 8/103; 156/272.8; 427/157; 428/690; 428/913

[58] Field of Search ..... 5/482, 495, 502; 8/102, 8/103; 156/67, 272.8; 427/157; 428/690, 913

[56] References Cited

U.S. PATENT DOCUMENTS

| | | | |
|---|---|---|---|
| D. 79,279 | 8/1929 | Bing . | |
| D. 90,729 | 9/1933 | Pulitzer . | |
| D. 95,781 | 5/1935 | Schumacher . | |
| D. 116,168 | 8/1939 | Lawson . | |
| D. 116,195 | 8/1939 | Steinweg . | |
| 3,266,063 | 8/1966 | Shapiro . | |
| 3,390,469 | 7/1968 | Rader . | |
| 3,613,133 | 10/1971 | Isola et al. . | |
| 3,801,420 | 4/1974 | Anderson . | |
| 4,062,076 | 12/1977 | Albertson . | |
| 4,442,558 | 4/1984 | Alexander . | |
| 4,588,409 | 5/1986 | Sercus | 8/102 X |

OTHER PUBLICATIONS

PHOBIAS "The Root of Phobias" publication.
"Sweet Pea" Bedroom Coordinates brochure.
Donaldsons advertising.
Central publication, p. 4.

*Primary Examiner*—Robert A. Dawson
*Attorney, Agent, or Firm*—Burd, Bartz & Gutenkauf

[57] ABSTRACT

A cover in the form of a blanket has a protective grid of phosphorescent material that when exposed to light and placed in a dark environment emits light for a period of time. The protective grid is a pattern of intersecting ribbons of phosphorescent material anchored to and covering substantially one surface of a fabric. The protective grid provides a visual light shield that creates an image of protection and is useable for amusement and entertainment.

32 Claims, 3 Drawing Sheets

METHOD OF MAKING PROTECTION COVER

This application is a division of U.S. patent application Ser. No. 934,462 filed Nov. 24, 1986, now U.S. Pat. No. 4,759,090.

FIELD OF INVENTION

The invention is in the general field of covers for objects and surfaces that provide a sense of security, comfort, and amusement. More particularly, the cover is a fabric having a protective grid of intersecting bands of phosphorescent material that establishes in darkness a perceived energized light shield that mitigates nyctophobia.

BACKGROUND OF INVENTION

Various types of bedding have been used to provide entertainment and personal comfort for persons. Examples of bedding products are disclosed by Shapiro in U.S. Pat. No. 3,266,063 and Isola et al in U.S. Pat. No. 3,613,133. Shapiro shows a bedspread which causes a bed to resemble a three dimensional object such as an automobile or a treasure chest. Isola et al relates to the illustration of characters on sheets, pillowcases or blankets with each layer depicting the characters in different stages of attire. Phosphorescent materials are used to enhance characters, such as a cartoon mouse, cat, dog, bear or horse on clothing and sheet member. These bed clothes make going to bed a desired activity for young persons. Conventional bed products loses its visual characteristics in a darkened room. These bedding products do not soothe the nyctophobic person. The person does not have a sense of security from the threat of imaginary monsters and evil spirits resulting in loss of sleep. Some persons have fears or phobias concerning darkness, slime, ghosts and monsters. This fear is rooted in a perception of force, power or a person or thing that is believed as threatening. Phobia clinics are available for diagnostic, testing, and treatment. One object of the cover of the invention is to provide a structure that is useful to comfort, amuse, and imply security to a person to mitigate phobia stress.

SUMMARY OF INVENTION

This invention is directed to a cover for amusing and pacifying persons. More particularly, the invention is a security blanket having a phosphorescent grid or pattern applied thereto which simulates a protected and shielded environment.

The cover has a sheet member, such as a fabric, having a visable surface. A protection pattern means is anchored to the surface and extends over substantially the entire surface to establish a visual shield that creates imaginary protection. The pattern means has phosphorescent material that when exposed to light and placed in a dark environment emits light for a period of time. The pattern means, in one form of the invention, comprises elongated coordinated intersecting ribbons of phosphorescent material anchored to the fabric. The ribbons make a grid that establishes a visual sheild that creates an image of protection for a person.

In one embodiment of the invention, the cover comprises a generally rectangular blanket having top and bottom sheet members. A grid or pattern of ribbons is anchored to the outer surface of the top sheet member. The grid has a plurality of intersecting ribbons of phosphorescent material, such as polyvinyl chloride plastisol ink. The ribbons form a graphic representation of a three dimensional protection shield. In a dark room the grid appears to pulsate between the two contour dimensions as the blanket is moved. The pulsating grid creates an imaginary protective environment as viewed by the person under the blanket. The grid has a plurality of diverging longitudinal ribbons and a set of transverse ribbons. The spacing between adjacent longitudinal ribbons and adjacent transverse ribbons increases from the lower edge of the blanket to the upper edge. The longitudinal and transverse ribbons are alternately wide and narrow. The changes in the spacing of the adjacent ribbons and the differences in their thickness produces a three dimension image of a shield or protection pattern. Diverging right and left diagonal ribbons pass through the intersections of the longitudinal and lateral ribbons. The diagonal ribbons are alternately wide and narrow similar to the longitudinal ribbons. The spacing between adjacent right diagonal ribbons increases from the lower right corner of the blanket to the upper left corner. The spacing between adjacent left diagonal ribbons increases from the lower left corner of the blanket to the upper right corner. This increases the three dimension image of the protection pattern.

The invention includes a method of making a cover having a surface provided with a light emitting protection grid. A fabric having color means is made to the desired size and shape of the cover. The fabric is bleached along bands that depict the grid to remove color means from the fabric along said bands. Ribbons of phosphorescent material are applied to the fabric over the bands to cover the bands with phosphorescent material. The phosphorescent material is heat cured to anchor the phosphorescent material to the fabric whereby the phosphorescent material becomes permanently affixed to the fabric and provides a protection grid that emits light when subjected to light and subsequently located in a dark environment. One type of phosphorescent material is a polyvinyl chloride plastisol ink having opague pigment. The material is applied to the fabric with a thickness of at least 2 mils to optimize its light emitting characteristics. The light from the phosphorescent material is visual through the bands so that there is light on both sides of the cover.

The cover and pattern of phosphorescent material thereon has soothing and relaxation effects which aids insomnia affected persons. The geometric light patterns provide changing optical images that mitigates insomnia. The light characteristics of the phosphorescent material and its pattern on substantially the entire external surface of at least one side of the cover enables a person to create light images with a flashlight and silhouettes of persons and objects on the cover. This provides the cover with novel entertainment and amusement features. The cover can be moved in the dark to create a dome configuration. The light from the phosphorescent material is visible from under the cover when the fiber fill or core has light transmitting features. A further feature of the cover is that it produces in a dark environment a soft and romantic light that can enhance spousal nocturnal relations. These and other objects and advantages of the cover of the inventor are embodied in the following description and drawings.

DESCRIPTION OF PREFERRED EMBODIMENT

Referring to FIGS. 1 to 4, there is shown a rectangular cover, indicated generally at 10 provided with a protection grid, indicated generally at 11. Cover 10 is a rectangular blanket or quilt useable as a bed covering for protection, concealment, and warmth. Cover 10 can be a cloth sheet, bedspread, coverlet, pillowcase or like bedding. The cover of the invention can take other forms, shapes, and uses such as wall coverings, drapes, curtains, floor coverings, rugs, clothing, as well as works of art. The following description is directed to a cover having the form of a blanket.

Protection grid 11 covers substantially the entire surface of cover 10. The grid 11 has a three dimensional shield image to provide a relatively wide and deep visual protection environment that has beneficial effects on persons afflicted with nyctophobia. The protection grid 11 also has beneficial attributes for other fears or phobias, such as myxophobia, phasmophobia, teratobphobia, and blennophobia. The fundamental quality of fear is rooted in a relationship to a force, power, or person that is perceived to be threatening. This behavorial fear can be masked and mitigated with the appropriate thereaupetic use of the cover 10 and its protection grid 11.

Cover 10 has fascinating entertainment and amusement characteristics in addition to its phobia protection shield. A person can draw designs on the cover with the use of a flashlight. The light eminating from the flashlight will energize the phosphorcent material of the grid so that in an dark environment, the created image will be visable. Silhouettes of persons and objects can be made on the cover by masking portions of the cover so that in the dark environment only the phosphorescent material that is exposed to light will produce a visible image. The grid of phosphorescent material produces in a dark environment a night light that has soft and romantic characteristics and aphrodisiac atmosphere is established which enhances noctural dosmetic spouse relations. The cover 10 can be changed to a dome configuration to establish a pulsating light which is visible from under the cover as well as the top of the cover. The light emitted by the protective grid in a dark environment or gradually diminishes. This creates a relaxing and soothing effect which is beneficial to persons afflicted by insomnia.

Figure 5:
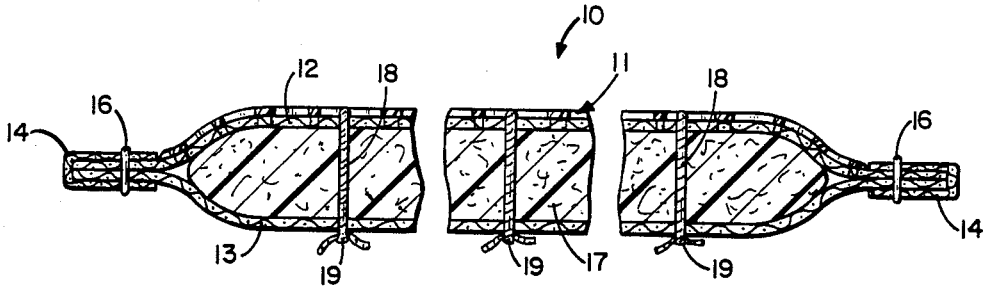
FIG. 5 is an enlarged foreshortened sectional view taken along line 5—5 of FIG. 11.

Cover 10 has a top fabric or sheet member 12 on which grid 11 is anchored. Grid 11 extends over substantially the entire top surface of the fabric 12. Fabric 12 is located over a bottom fabric or sheet member 13 to form the opposite side of cover 10. A border band 14 is attached with stitches 16 to the outer adjacent outer peripheral edges of top and bottom fabrics 12 and 13. As shown in FIG. 5, border band 14 has a generally transversed U-shaped cross section with stitches 16 securing the upper and lower portions of band 14 to the outer peripheral overlapping and engaging edges of top and bottom fabrics 12 and 13. The outer peripheral edges of fabrics 12 and 13 can be hemmed to provide a finished border made by folding back the fabric and sewing it down. An ornamental border or fringe or galloon can be secured to the outer peripheral edge of the cover 10. Other types of fasteners and connectors can also be used to attach the outer edges of fabrics 12 and 13 together.

A generally flat core of insulation material or fiberfill, including natural and synthetic fibers and one or more foam sheets, is interposed between fabrics 12 and 13. Core 17 fills the space between fabrics 12 and 13 to retain the fabric in a generally flat condition and hold core 17 generally flat. Core 17 has a thickness of about one half of a conventioal blanket core. Preferably, the core 17 has a thickness of less than 3 cm. Core 17 allows light to pass through it so that the light emitted from phosphorescent material on fabric 12 can be viewed from the bottom side of cover 10. The material of core 17 dispurses the light from the phosphorescent material to create a broad lighting effect. The core material can be a natural or synthetic fiber mat. The fibers can be colorless or white to allow light to pass through the core.

Figure 2:
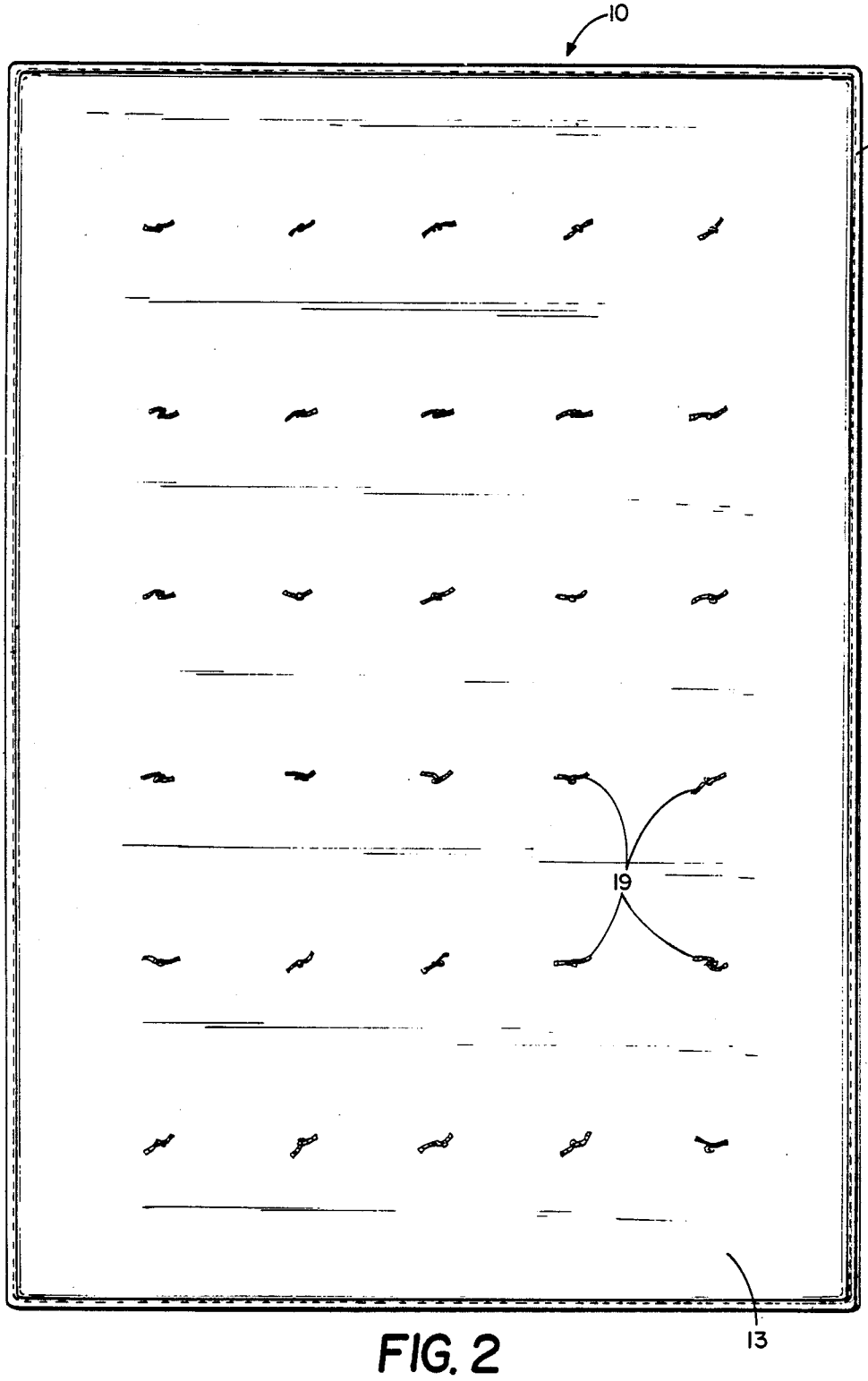
FIG. 2 is a bottom view of FIG. 1.
Figure 3:
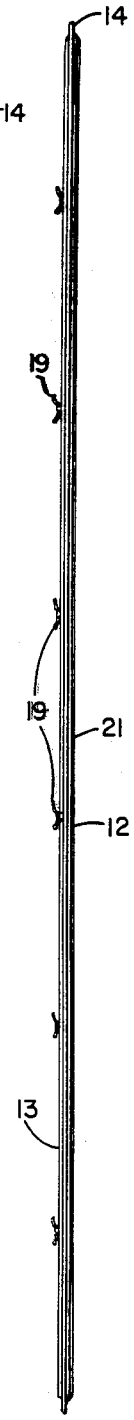
FIG. 3 is a side view of FIG. 2.
Figure 4:
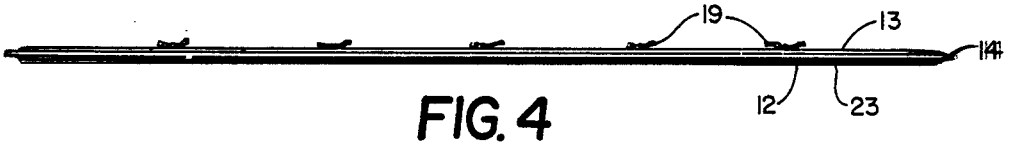
FIG. 4 is an end view of FIG. 2.

Core 17 is prevented from sagging or bunching up in cover 10 with a plurality of ties 18, such as cords or yarn, extended through top and bottom fabrics 12 and 13 and core 17. The ends of ties 18 are attached together with knots 19 adjacent bottom fabric 12. Ties 18, as shown in FIG. 2, are positioned in a generally rectangular pattern in horizontal and vertical rows. This arrangement of ties 18 inhibits the shifting of core 17 between fabrics 12 and 13. Other types of core holding structures, including stitches, buttons, webs, and adhesives, can be used to maintain the position of core 17 between fabrics 12 and 18.

Figure 1:
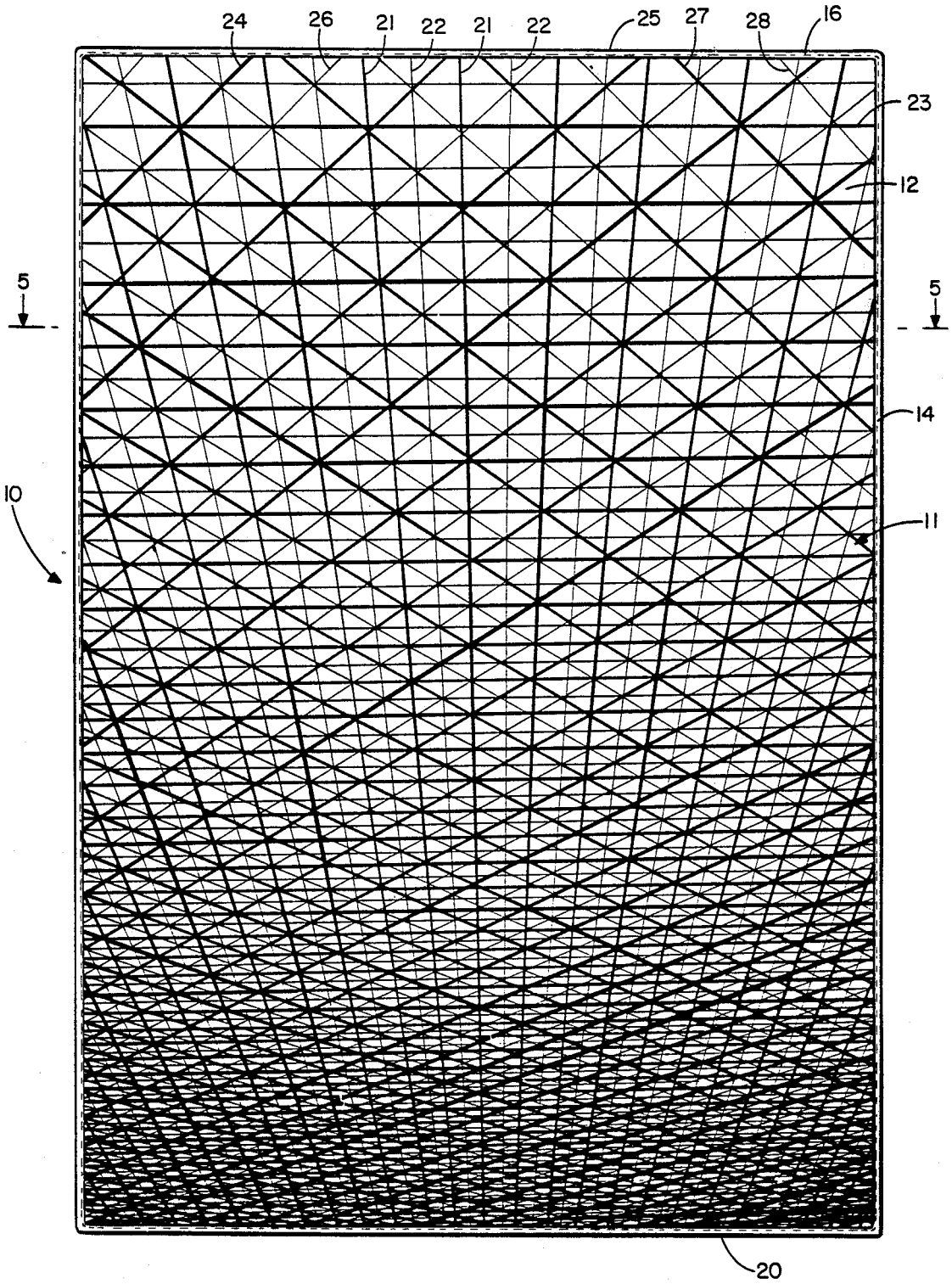
FIG. 1 is a top plan view of a cover having a phosphorescent grid.
Figure 6:
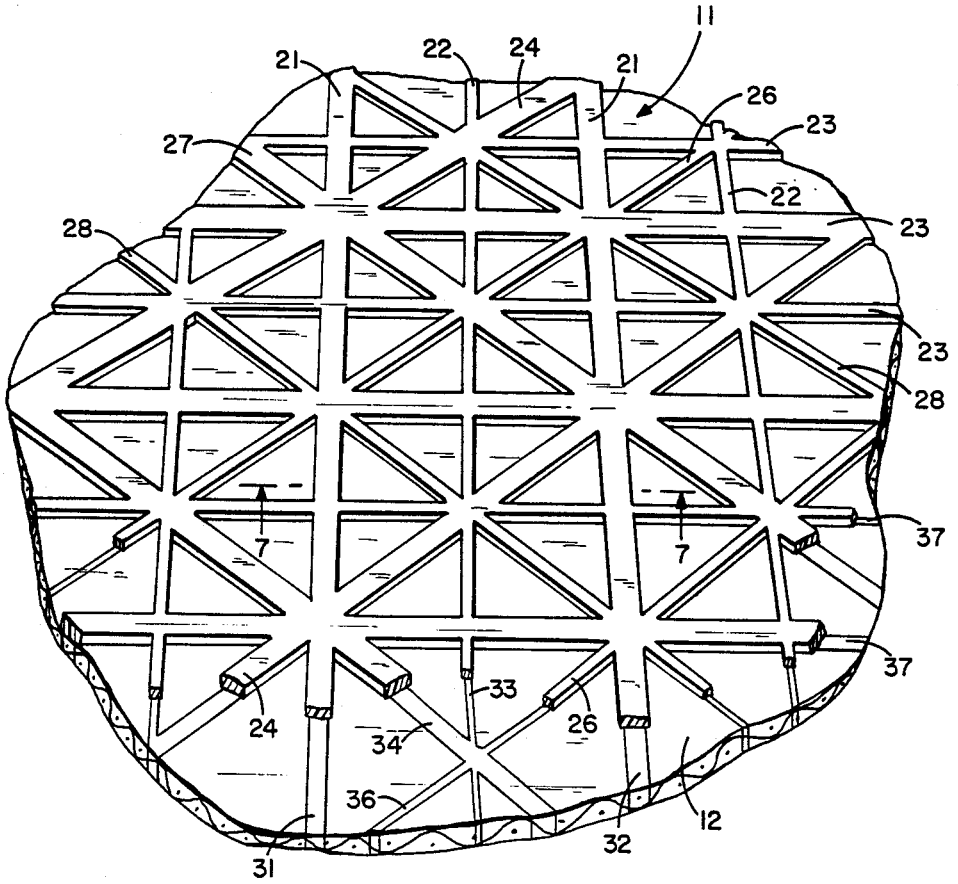
FIG. 6 is a perspective view of the top fabric and phosphorescent grid thereon.

Referring to FIGS. 1 and 6, protection grid is a shield pattern comprising a plurality of laterally spaced longitudinal ribbons 21 of phosphorescent material. The ribbons diverge outwardly from each other starting from the lower edge of cover 10. The center ribbon 21 is located linearly along the center line of fabric 12. First longitudinal ribbons 21 are coordinated with a plurality of second longitudinal ribbons 22. The second ribbons 22 have a width that is smaller than the width of the first ribbons 21 to produce a diminishing or recessive effect relative to the dominant ribbons 21. The width of the second ribbon 22 is about one half of the width of the dominant ribbon 21. Ribbons 22 are interposed between the ribbons 21 and taper in an outwardly direction from the first or bottom edge 20 to the second or top edge 25 of cover 10. The grid includes a plurality of transverse ribbons 23. The ribbons 23 extend laterally across the fabric 12. The lateral spacing between adjacent ribbons 23 increases from the first edge 20 to the second edge 25 of cover 10. The spacing progressively increases between the adjacent transverse ribbons 23 to provide the protection grid 11 with visual longitudinal length.

Protection grid 11 includes right and left diagonal lines 24, 26 and 27, 28 that pass through the intersections of the longitudinal and transverse ribbons 23 and 21 respectively. Right diagonal ribbons include a first wide ribbon 24 and a second narrow ribbon 26. The wide narrow pattern of the ribbons 24 and 26 is repeated from the lower right corner of cover 10 to the upper left corner of cover 10. The left diagonal ribbons 27 and 28 commence at the lower right corner of cover 10 and progressively increase in the spaced relation with each other to the upper left corner of cover 10. The left diagonal ribbons pass through the intersections between longitudinal ribbons 21 and 22 and transverse ribbon 23.

Protection grid 11 has a first generally rectangular coordinated ribbon pattern comprising the diverging longitudinal ribbons 21 and 22 and the general transverse ribbon 23. The spacing between the respective longitudinal ribbons and the respective transverse ribbons increases from the first edge 20 of cover to the second edge thereof. The second and third diagonal patterns of ribbons are generally normal to each other and are superimposed on the first rectangular coordinated ribbon pattern. The changes in the spacing of the first and second coordinated ribbon patterns and the differences in the thicknesses of the adjacent ribbons produces a three-dimensional image of a shield or protection pattern.

Figure 7:
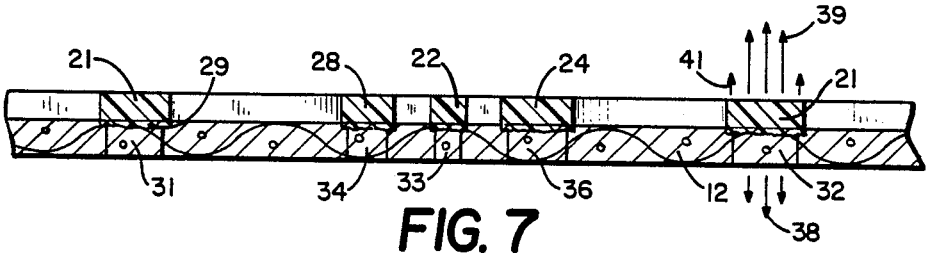
FIG. 7 is an enlarged sectional view taken along line 7—7 of FIG. 6.

Referring to FIGS. 6 and 7, the ribbons of phosphorescent material are anchored to fabric 12. The thickness of each ribbon is between 2 and 3 mils. to optimize its light emitting characteristics. The phosphorescent material is a polyvinyl chloride plastisol ink. This material is a polyvinyl chloride resin that includes phosphorescent pigment, preferably yellow-green in color to provide the phosphorescent material with opague characteristics. The phosphorescent material can have color additives to produce color such as red, green, blue, yellow and the like. The polyvinyl chloride phosphorescent material is flexible, nonflamable and non-toxic after it is heat cured and bonded to the fabric 12. The polyvinyl chloride and pigments and phosphorescent material contained therein are biologically inert as they do not irritate skin tissue nor are they prone to protein build-up that can produce a skin reaction. The phosphorescent material is permanently affixed to the fabric 12 and does not dissolve in water and bleach solution used to wash and/or clean the cover 10. The phosphorescent material also does not deteriorate over the life of the cover.

A method of making cover 10 is described as follows. A sheet member of fabric 12 having color means such as dye and natural colors, such as ecru, found in natural fibers, is made to a selected size and shape of the final cover. The color means, such as dyes and the like, are removed from the fabric along longitudinal bands 31, 32, and 33 and diagonal bands 34 and 36, as well as transverse bands 37 for the longitudinal,. diagonal and transverse ribbons. The bands are in the format of the grid or pattern 11 of the phosphorescent material that is applied to fabric 12. Each of the bands, as shown in FIG. 7, has a width that is less than the width of the ribbon that covers the band. The ribbons have lateral edges that extend beyond the sides of the bands so as to completely cover the bands. The overlapping relationship between the ribbons and the bands also allows for manufacturing tolerances in that the bands do not have to be precisely located on the fabric 12 to cover the bands. When the coloring means has been removed from the fabric 12, the phosphrescent material of the ribbons will emit light and penetrate the fabric 12 as indicated by arrow 38 in FIG. 7. The light passes through the core 17 and is visible from the underside of cover 10. The removal of the color means from bands 12 also enhances the light or glow or light emitting characteristics of te phosphorescent material. When the phosphorescent material is placed over a fabric having dyes, its light emitting characteristics are diminished. As shown in FIG. 7, arrows 30 show the enhanced light emission from phosphorescent material 21 and arrows 41 indicate the diminished light emitting characteristics. The differences in the light intensity of the fluourscent ribbon 21 produces a rail or tube visual image. On movement of cover 10 the light emitted by the ribbons, create an illusion of surging or pulsating light energy.

The color means, such as dyes, ecru, and other materials that inhibit the passage of light through the fabric 12 are removed by a bleaching process. Chemical agents can be used to bleach the fabric along the bands by either oxidation or reduction. Bleaching powders, such as chlorinated lime or calcium hypochlorite can be used as bleach solutions. Light, such as intense sunlight and laser light can be used to remove the color means from fabric 12 along the pattern bands. Subsequent to the bleaching process, fabric 12 can be cleaned or washed to remove all bleaching agents. Alternatively, the bleaching agents can be neutralized. Drum applicators can be used to apply the bleaching agent to fabric 12 along the selected pattern lines to produce the colorless bands.

The sheet member or fabric 12 is then placed in a generally flat position for the application of the ribbons of phosphorescent material. Large presses having engraved rollers are used to emboss the polyvinyl chloride plastisol ink on the fabric in accordance with the protective grid or pattern 11. The ribbons of phospshorescent material have a thickness of 2 to 3 mils. Preferably, the ribbons have a thickness of at least 2 mils to enhance the light emitting characteristics of the phosphorescent material. The ribbons of phosphorescent material may be applied to the fabric 12 by other methods such as spraying , air brush, silk screen, painting, or stamping.

After the ribbons of phosphorescent material have been applied to fabric 12, the phosphorescent material is heat cured. The phosphorescent material during the curing, anchors or bonds to the fabric. The curing can be accomplished with heaters, including infrared light.

Cover 10 is completed into a blanket or quilt by sandwiching the core 17 between the fabrics 12 and 13. Border band 14 is then stitched to the outer peripheral edges of fabrics 12 and 13. Ties 18 are then inserted through the fabrics 12 and 13 and core 17 and tied with a knot 19. Appropriate bedding labels are affixed to the cover during the construction thereof.

While there has been shown and described preferred embodiment of the cover of the invention it is understood that changes in the size, materials, protective patterns, and the methods of removing color from the fabrics and applying phosphorescent material to the fabric may be made by those skilled in the art without departing from the invention. For example, the ribbons of phosphorescent material may be dashed or interrupted or a series of in-lined dots or squares to form the protective pattern on the fabric. The invention is defined in the following claims.

I claim:

1. A method of making a cover having a surface provided with a light emitting protection grid comprising: providing a fabric having color means and a size and shape of the cover, bleaching the fabric along bands that depict the the grid of the cover to remove color means from the fabric along said bands, appling continuous ribbons of phosphorescent material to the fabric along the bands to cover the bands with phosphorescent material and curing the phosphorescent material and anchoring the phosphorescent material to the fabric whereby the phosphorescent material becomes permanently affixed to the fabric and provides a protection grid that emits light when subjected to light and subsequently located in a dark environment.

2. The method of claim 1 wherein: the fabric is bleached along said bands with light.

3. The method of claim 2 wherein: the light is a laser beam of light.

4. The method of claim 1 wherein: the fabric is bleached along said bands with a chemical agent to remove color means from the fabric along said bands.

5. The method of claim 1 wherein: the phosphorescent material is applied to a thickness of between 2 to 3 mils.

6. The method of claim 1 wherein: the phosphorescent material is applied to a thickness of at least 2 mils.

7. The method of claim 1 wherein: the phosphorescent material is subjected to heat to cure the phosphorescent material and anchor the phosphorescent material to the fabric.

8. The method of claim 1 wherein: the ribbons of phosphorescent material each have a width greater than the width of the band to be covered by a ribbon, each ribbon when applied to the fabric extending laterally from opposite sides of a band.

9. The method of claim 1 wherein: a poly vinyl chloride resin phosphorescent material is applied to the fabric to cover the bands thereon.

10. The method of claim 1 wherein: the bands are bleached along linear lines and extend over substantially the entire surface of the cover, said ribbons of phosphorescent material located only over the bands and extended over substantially the entire dimensions of the surface of the cover.

11. The method of claim 1 wherein: the bands are bleached along first linear lines and second linear lines located at an angle relative to the first linear lines, said bands located over substantially the entire surface of the cover, said ribbons of phosphorescent material located only over said bands and extended over substantially the entire dimensions of the surface of the cover.

12. A method of making a cover having a surface provided with light emitting protection pattern comprising: providing a sheet member having color means and a size and shape of the cover, removing the color means from the sheet member along bands that depict the pattern, applying ribbons of phosphorescent material along the bands, and curing the phosphorescent material and anchoring the phosphorescent material to the sheet member whereby the phosphorescent material becomes permanently affixed to the sheet member and provides a protection pattern that emits light when subjected to light and subsequently located in a dark environment.

13. The method of claim 12 wherein: the color means is removed from the sheet member by bleaching the sheet member along said lines with light.

14. The method of claim 13 wherein: the light is a laser beam of light.

15. The method of claim 12 wherein: the color means is removed from the sheet member along said bands by bleaching with a chemical agent.

16. The method of claim 12 wherein: the phosphorescent material is applied to a thickness of between 2 to 3 mils.

17. The method of claim 12 wherein: the phosphorescent material is applied to a thickness of at least 2 mils.

18. The method of claim 12 wherein: the phosphorescent material is subjected to heat to cure the phosphorescent material and anchor the phosphorescent material to the sheet member.

19. The method of claim 12 wherein: the ribbons of phosphorescent material each have a width greater than the width of the band to be covered by a ribbon, each ribbon when applied to the sheet member extending laterally from opposite sides of a band.

20. The method of claim 12 wherein: a polyvinyl chloride resin phosphorescent material is applied to the sheet member to cover the bands thereon.

21. The method of claim 12 wherein: the bands extend along linear lines over substantially the entire surface of the cover, said ribbons of phosphorescent material located only over the bands and extended over substantially the entire dimensions of the surface of the cover.

22. The method of claim 12 wherein: the bands are located along first linear lines and second linear lines, said second linear lines being positioned at an angle relative to the first lines, said bands located over substantially the entire surface of the cover, said ribbons of phosphorescent material located only over said bands and extended over substantially the entire dimensions of the surface of the cover.

23. The method of claim 22 wherein: alternative ribbons of phosphorescent material have different widths with the width of one ribbon being about one half the width of the other ribbon.

24. A method of making a cover having at least one surface provided with a light emitting pattern comprising: providing a sheet member having one surface and a size and shape of the cover, applying a pattern of polyvinyl chloride resin phosphorescent material to substantially the entire one surface of the sheet member, and curing the phosphorescent material and anchoring the phosphorescent material to the sheet member whereby the phosphorescent material becomes permanently affixed to the sheet member and provides a pattern over substantially the entire one surface of the sheet member that emits light when subjected to light and subsequently located in a dark environment.

25. The method of claim 24 wherein: the phosphorescent material is applied to a thickness of at least 2 mils.

26. The method of claim 24 wherein: the phosphorescent material is subjected to heat to cure the phosphorescent material and anchor the phosphorescent material to the sheet member.

27. The method of claim 24 wherein: the pattern of phosphorescent material includes a plurality of first linear ribbons and a plurality of second linear ribbons positioned at an angle relative to the first linear ribbons.

28. The method of claim 27 wherein: the first and second ribbons are generally normal to each other, and a plurality of third right diagonal ribbons, and a plurality of fourth left diagonal ribbons passing through the intersections of the first and second ribbons.

29. The method of claim 27 wherein: the sheet member has a first edge and a second edge opposite the first edge, said first ribbons extending between said first and second edges and converging relative to each other from the first edge to the second edge of the sheet member.

30. The method of claim 27 wherein: the sheet member has a first edge and a second edge opposite the first edge, said second ribbons extending generally parallel to the first edge, the lateral spacing between adjacent second ribbons increasing from the first edge to the second edge of the cover.

31. The method of claim 27 wherein: the first ribbons extend between said first and second edges and diverge relative to each other from the first edge to the second of the sheet member.

32. The method of claim 31 wherein: alternate ribbons of the first and second ribbons have different widths with one width being about one-half the other width.

* * * * *